US012532917B2

(12) United States Patent
Zhang et al.

(10) Patent No.: US 12,532,917 B2
(45) Date of Patent: Jan. 27, 2026

(54) ATOMIZING CORE, ATOMIZER AND ELECTRONIC ATOMIZATION DEVICE

(71) Applicant: SHENZHEN SMOORE TECHNOLOGY LIMITED, Shenzhen (CN)

(72) Inventors: Zhao Zhang, Shenzhen (CN); Hongliang Luo, Shenzhen (CN); Congwen Xiao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 274 days.

(21) Appl. No.: 17/504,714

(22) Filed: Oct. 19, 2021

(65) Prior Publication Data

US 2022/0117305 A1 Apr. 21, 2022

(30) Foreign Application Priority Data

Oct. 20, 2020 (CN) ..... 202011122841.1

(51) Int. Cl.

| | |
|---|---|
| ***A24F 40/46*** | (2020.01) |
| ***A24F 40/10*** | (2020.01) |
| ***A24F 40/40*** | (2020.01) |
| ***A24F 40/42*** | (2020.01) |
| ***A24F 40/44*** | (2020.01) |

(52) U.S. Cl.

CPC ..... *A24F 40/46* (2020.01); *A24F 40/40* (2020.01); *A24F 40/42* (2020.01); *A24F 40/44* (2020.01); *A24F 40/10* (2020.01)

(58) Field of Classification Search

None

See application file for complete search history.

(56) References Cited

U.S. PATENT DOCUMENTS

| | | | | |
|---|---|---|---|---|
| 10,502,409 | B2 | 12/2019 | Meinhart et al. | |
| 2017/0006916 | A1 | 1/2017 | Liu | |
| 2018/0007741 | A1* | 1/2018 | Metz | H05B 6/362 |

(Continued)

FOREIGN PATENT DOCUMENTS

| | | | |
|---|---|---|---|
| CN | 209346085 | U | 9/2019 |
| CN | 110313642 | A | 10/2019 |

(Continued)

OTHER PUBLICATIONS

CN-210329343-U English translation obtained from Espacenet, pp. 1-9 (Year: 2020).*

(Continued)

*Primary Examiner* — Philip Y Louie
*Assistant Examiner* — Madeleine P Delacruz
(74) *Attorney, Agent, or Firm* — Ballard Spahr LLP

(57) ABSTRACT

One or more examples relate to an atomizing core, an atomizer and an electronic atomization device. The atomizing core includes: a substrate, having an atomization surface and being configured to buffer and conduct a liquid; a heating element, comprising a heating portion attached to the substrate, the heating portion being capable of generating heat to atomize the liquid on the atomization surface to form smoke; and a protective layer, provided on the atomization surface and covering the heating portion, and smoke being capable of overflowing from the protective layer.

14 Claims, 8 Drawing Sheets

(56) References Cited

U.S. PATENT DOCUMENTS

| | | | | |
|---|---|---|---|---|
| 2019/0223504 | A1* | 7/2019 | Chen | A24F 40/485 |
| 2019/0246692 | A1 | 8/2019 | Li et al. | |
| 2020/0352256 | A1* | 11/2020 | Hejazi | A61M 15/06 |

FOREIGN PATENT DOCUMENTS

| | | | | | |
|---|---|---|---|---|---|
| CN | 110447959 | A | | 11/2019 | |
| CN | 210329343 | U | * | 4/2020 | |
| CN | 111134372 | A | | 5/2020 | |
| CN | 111148288 | A | | 5/2020 | |
| CN | 210782909 | U | * | 6/2020 | A24F 40/10 |
| CN | 111387555 | A | | 7/2020 | |
| CN | 214431822 | U | | 10/2021 | |
| KR | 2015047616 | A | * | 5/2015 | A24F 40/10 |
| KR | 101927135 | B1 | | 12/2018 | |
| WO | WO-2016041114 | A1 | * | 3/2016 | A24F 47/00 |
| WO | 2017066955 | A1 | | 4/2017 | |
| WO | 2019157650 | A1 | | 8/2019 | |

OTHER PUBLICATIONS

KR-2015047616-A English Translation obtained from Espacenet, pp. 1-22 (Year: 2015).*

CN-210782909-U English Translation obtained from PE2E Search, pp. 1-9 (Year: 2020).*

English Translation of WO2016041114 obtained from Espacenet, pp. 1-8 (Year: 2016).*

Extended European Search Report from European Application No. 21203652.9 mailed Apr. 7, 2022.

First Office Action for Chinese Application No. 202011122841.1 mailed Oct. 31, 2024.

Shujie , et al., "Analysis of Atomizing Technology for Heating Wire of Electronic Cigarette", Electronic Measurement Technology. DOI: 10.19651/j.cnki.emt.1801875, Sep. 2018, pp. 119-122.

* cited by examiner

ATOMIZING CORE, ATOMIZER AND ELECTRONIC ATOMIZATION DEVICE

CROSS-REFERENCE TO RELATED APPLICATION

This application claims priority of the Chinese Patent Application No. 202011122841.1, entitled "Atomizing core, Atomizer and Electronic Atomization Device", filed on Oct. 20, 2020, the entire contents of which is incorporated herein by reference.

TECHNICAL FIELD

The present disclosure relates to the field of atomization technology, and particularly to an atomizing core, an atomizer and an electronic atomization device.

BACKGROUND

The electronic atomization devices have an appearance and taste similar to ordinary cigarettes, but usually do not contain other harmful components such as tar, suspended particles and the like in the cigarettes. Therefore, the electronic atomization devices are commonly used as substitutes for the cigarettes. An electronic atomization device usually includes an atomizer. The atomizer includes an atomizing core. The atomizing core includes a substrate and a heating element. The substrate blocks a liquid storage cavity in the atomizer and can buffer and conduct the liquid in the liquid storage cavity. The heating element is arranged on the substrate and configured to atomize the liquid conducted to the substrate to form smoke that can be sucked by the user. However, for conventional atomizers, smoke accumulates on the surface of and around the heating element, as the smoke continues to accumulate, it will lead to formation of burnt or other peculiar smells in the smoke, thereby affecting the user experience.

SUMMARY

The technical problem to be solved by the present disclosure is how to prevent the tobacco soot from accumulating on the surface and periphery of the heating element.

An atomizing core, including:

a substrate, having an atomization surface and being configured to buffer and conduct a liquid;

a heating element, including a heating portion attached to the substrate, the heating portion being capable of generating heat to atomize the liquid on the atomization surface to form smoke; and a protective layer, provided on the atomization surface and covering the heating portion, and smoke being capable of overflowing from the protective layer.

In an embodiment, micropores are formed in the protective layer with a porosity in a range of 30% to 70%, and a thickness of the protective layer is in a range of 100 μm to 500 μm.

In an embodiment, the heating element further includes electrode portions configured to conduct electricity, the electrode portion is electrically connected to the heating portion, and the protective layer covers all the electrode portions.

In an embodiment, the protective layer has a covering surface provided towards the atomization surface, the covering surface is recessed to form a groove, and at least a part of the heating portion is matched with the groove.

In an embodiment, the heating portion has a line-shaped structure or a membrane-shaped structure; when the heating portion is the membrane-shaped structure, the thickness of the heating portion is in a range of 30 μm to 130 μm.

In an embodiment, micropores are formed in the substrate with a porosity in a range of 20% to 70%, and a thickness of the substrate is in a range of 2 mm to 5 mm.

An atomizing core, including:

a substrate, having an atomizing surface and being configured to buffer and conduct a liquid;

a heating element, including a heating portion attached to the substrate, the heating portion be capable of generating heat to atomize the liquid on the atomization surface to form smoke; and a protective layer, provided on the atomization surface, wherein the protective layer has a bottom surface that faces away from the atomization surface, and the bottom surface is provided with a through groove passing through the protective layer, at least a part of the heating portion is located in the through groove, and a surface of the heating portion in the through groove is kept at a set distance from the bottom surface along a thickness direction of the protective layer.

In an embodiment, the protective layer has a covering surface arranged opposite to the bottom surface to cover the atomization surface, and the protective layer is provided with a vent hole passing through the covering surface and in communication with outside, and smoke is capable of overflowing from the vent hole.

In an embodiment, the vent hole forms a through opening on the covering surface, the through opening has an orthographic projection on the atomization surface, and the orthographic projection is kept at a set distance from a coverage of the heating portion.

In an embodiment, the vent hole has an orthographic projection on the atomization surface, and the orthographic projection is kept at a set distance from a coverage of the heating portion.

In an embodiment, a central axis of the vent hole is arranged at an acute angle with the atomization surface; or, the vent hole includes a first bending section and a second bending section which are in communication with each other, the first bending section passing through the covering surface, the second bending section is in direct communication with the outside, a central axis of the first bending section is arranged at an angle with the atomization surface, a central axis of the second bending section is arranged at an angle with the central axis of the first bending section.

An atomizer, including a liquid storage cavity and the atomizing core according to any one of the above embodiments, and the substrate further has a liquid absorption surface facing opposite to the atomization surface, the liquid absorption surface is configured to absorb a liquid in the liquid storage cavity into the substrate.

An electronic atomization device, including a power supply and the above-mentioned atomizer, the power supply is electrically connected to the heating element.

A technical effect of an embodiment of the present disclosure is that, by providing the protective layer, most of the liquid particles and solid particles in the smoke flowing back to the atomizing core are directly absorbed in the protective layer, so that the protective layer has good filtration function to prevent part of the liquid particles and solid particles from flowing to the atomization surface to form tobacco soot accumulated on the surface and periphery of the heating part, thereby greatly reducing the proportion of liquid particles and solid particles in the smoke that are converted into the tobacco soot, and reducing the amount of tobacco soot accumulated on the surface and periphery of the heating portion.

DETAILED DESCRIPTION OF THE EMBODIMENTS

In order to facilitate understanding of the disclosure, the disclosure will be described more comprehensively below with reference to the accompanying drawings. Preferred embodiments of the present disclosure are shown in the accompanying drawings. However, the present disclosure can be implemented in many different forms and is not limited to the embodiments described herein. Rather, the objective of these embodiments is to provide more thorough understanding of the present disclosure.

It should be noted that when an element is referred to as being "fixed" to another element, it can be directly on the other element or there may be an intermediate element. When an element is considered to be "connected" to another element, the element can be directly connected to the other element or there may be an intermediate element at the same time. The terms "inside", "outside", "left", "right" and the like used herein are for illustrative purposes only and are not meant to be the only embodiments.

Figure 1:
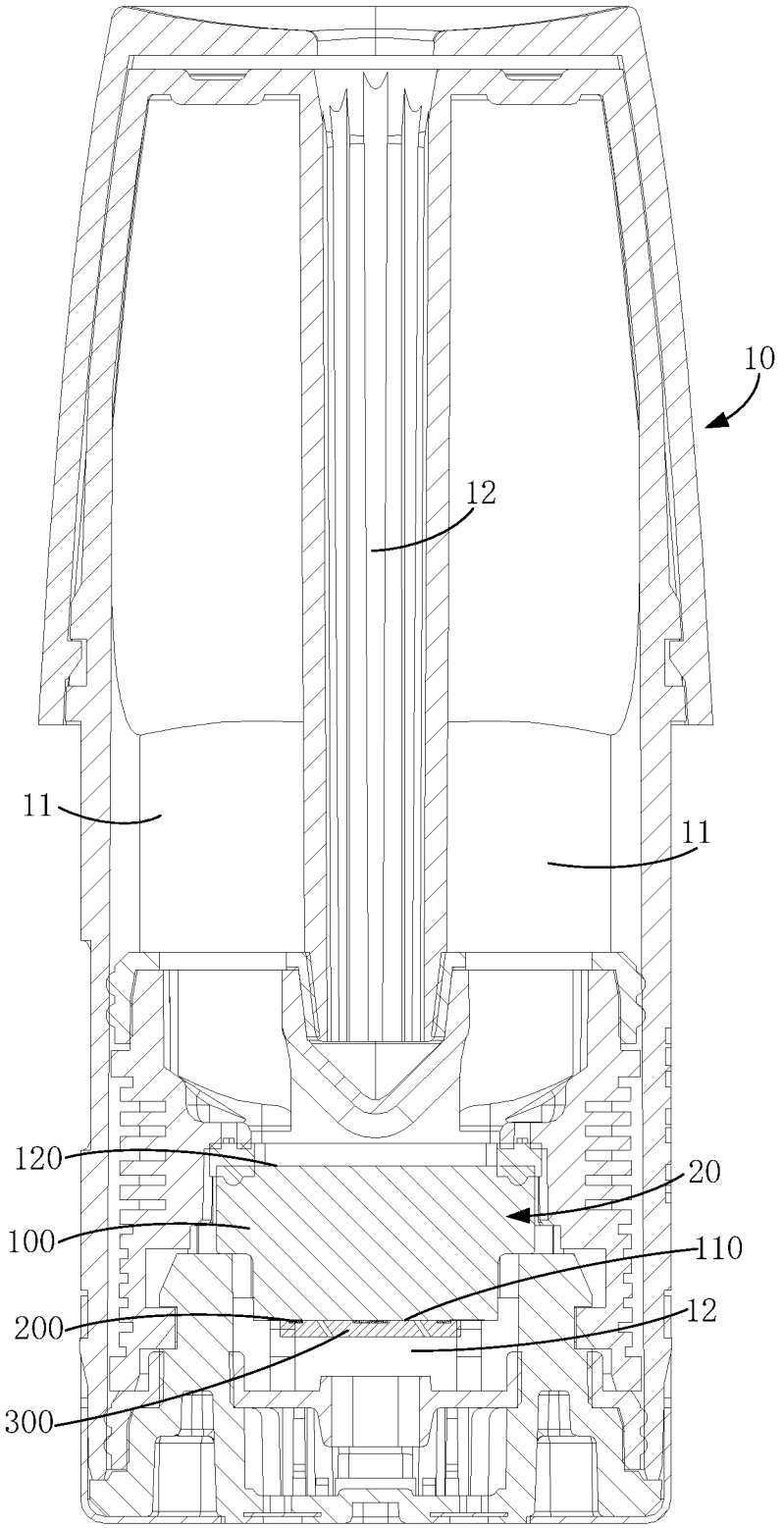
FIG. 1 is a schematic section view of an atomizer according to an embodiment of the present disclosure.

Referring to FIG. 1, an atomizer 10 provided in an embodiment of the present disclosure is provided with a liquid storage cavity 11 and an airflow passage 12; and the liquid storage cavity 11 and the airflow passage 12 are isolated from each other and not communicated with each other. The liquid storage cavity 11 is configured to store an aerosol generating matrix represented by a liquid. When the liquid is atomized to form smoke (aerosol), the smoke is discharged into the airflow passage 12 for the user to smoke. The atomizer 10 includes an atomizing core 20; and the atomizing core 20 includes a substrate 100, a heating element 200 and a protective layer 300. A large number of micropores are formed inside the substrate 100. Due to the existence of the micropores, the entire substrate 100 has a certain porosity. The porosity can be defined as a percentage of a total volume of the micropores in a volume of the entire substrate 100. A unit value of the porosity can be in a range of 20% to 70%, for example, the specific value can be 20%, 30%, 60%, or 70%. In view of the certain porosity of the substrate 100, the substrate 100 can produce capillary action to absorb and conduct the liquid, that is, the substrate 100 can have certain buffer and conduction effects on the liquid.

Figure 2:
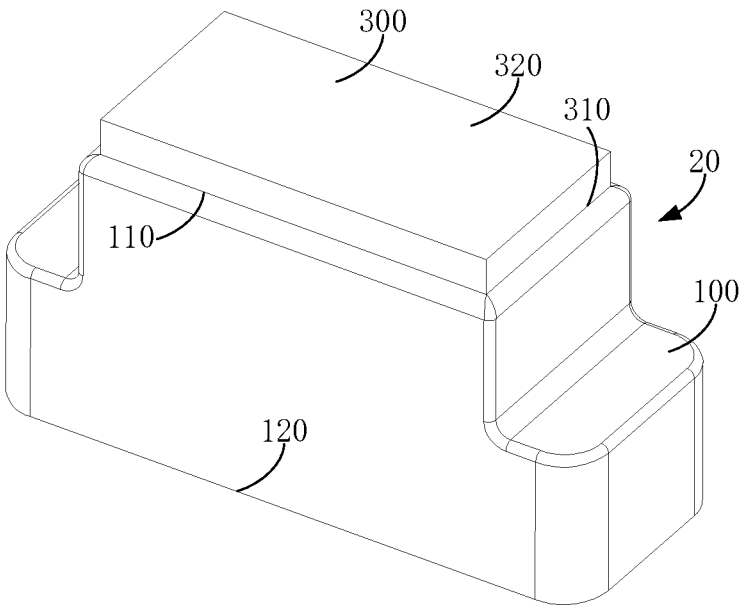
FIG. 2 is a schematic three-dimensional structure diagram of an atomizing core of the automizer shown in FIG. 1 according to an embodiment of the present disclosure.
Figure 3:
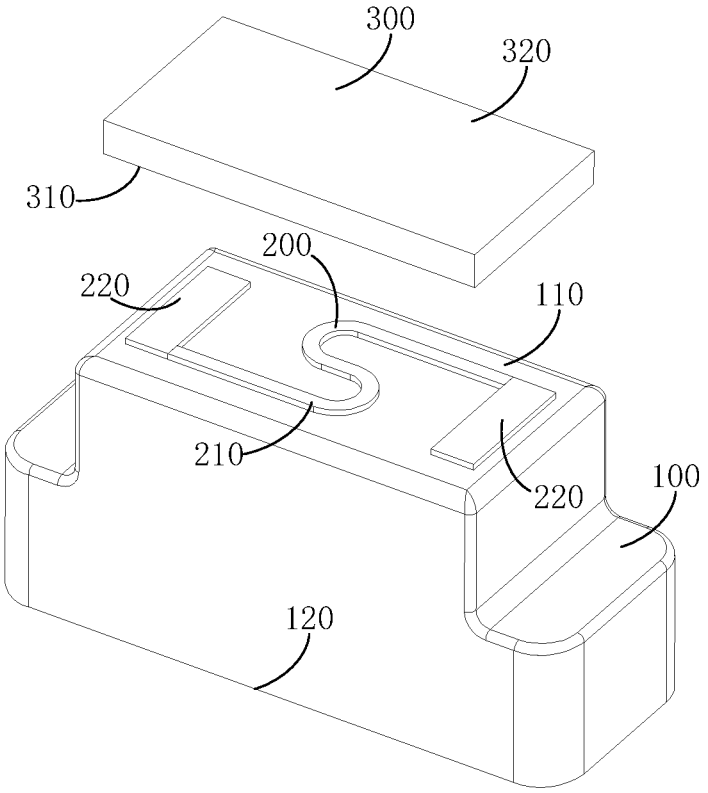
FIG. 3 is a schematic exploded structure diagram of the atomizing core shown in FIG. 2.
Figure 4:
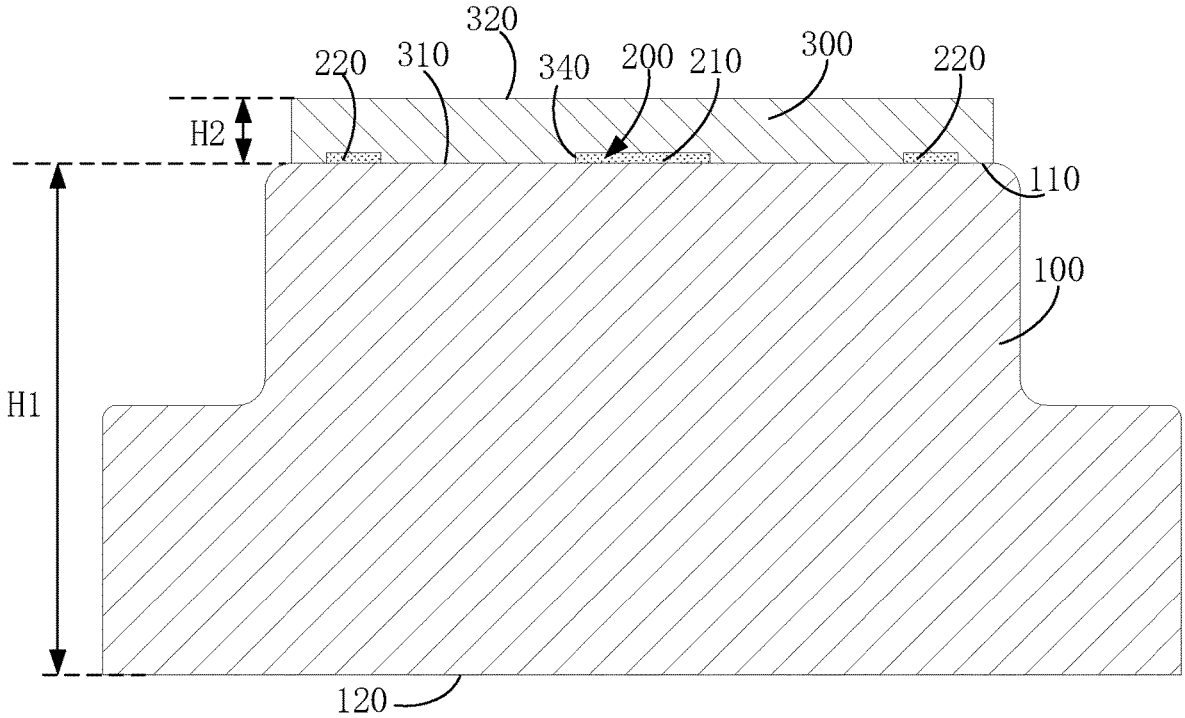
FIG. 4 is a schematic plane section view of the atomizing core shown in FIG. 2.

FIGS. 2, 3 and 4, the substrate 100 has an atomization surface 110 and a liquid absorption surface 120. The atomization surface 110 and the liquid absorption surface 120 face oppositely; and the liquid absorption surface 120 is configured to absorb the liquid in the liquid storage cavity 11 into the substrate 100. For example, the substrate 100 directly forms a sealing effect on the liquid storage cavity 11, so that the liquid absorption surface 120 defines a part of a boundary of the liquid storage cavity 11; accordingly, the liquid in the liquid storage cavity 11 is in direct contact with the liquid absorption surface 120. Through the capillary action of the micropores in the substrate 100, the liquid in the liquid storage cavity 11 enters the interior of the substrate 100 through the liquid absorption surface 120 and is conducted to the atomization surface 110. A conduction velocity of the liquid inside the substrate 100 is in direct proportion to the porosity, accordingly the conduction velocity of the liquid can be changed by changing the porosity of the substrate 100. A thickness H1 of the substrate 100 ranges from 2 mm to 5 mm. The thickness of the substrate 100 can be defined as a distance between the liquid absorption surface 120 and the atomization surface 110. A specific value of the thickness of the substrate 100 can be 2 mm, 3 mm, 4 mm or 5 mm. The substrate 100 can be made of ceramic materials or glass materials. The ceramic and glass materials have relatively stable chemical properties, which can prevent the production of toxic gases from chemical reactions of the substrate 100 at a high temperature, and prevent smoke carrying the toxic gases from smoking by the user, in order to ensure the safety of the use of the atomizer 10.

Figure 5:
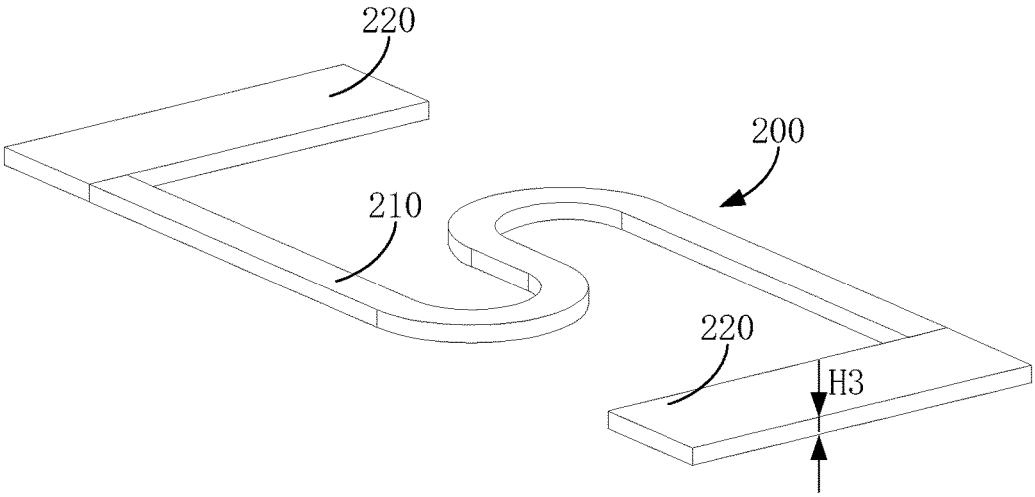
FIG. 5 is a schematic three-dimensional structure diagram of a heating element in the atomizing core shown in FIG. 2.

FIGS. 3 and 5, in some embodiments, the heating element 200 includes a heating portion 210 and an electrode portion 220. The number of the electrode portions 220 may be two; one of the electrode portions 220 can serve as a positive electrode and is electrically connected to one end of the heating portion 210; and the other electrode portion 220 can serve as a negative electrode and is electrically connected to the other end of the heating portion 210. A resistance of the electrode portion 220 is much smaller than a resistance of the heating portion 210, so that the electrode portion 220 has good electrical conductivity. Since the electrode portion 220 and the heating portion 210 are used in series, when the entire heating body 200 is energized, the heating portion 210 can produce a large amount of heat, and the heat generated on the electrode portion 220 can be relatively negligible.

The heating portion 210 can be provided on the substrate 100 by means of screen printing. For example, the heating portion 210 can be directly attached to the atomization surface 110 so that the heating portion 210 protrudes from the atomization surface 110 to a certain height. For another example, a part of the atomization surface 110 is recessed to form a sink groove, and the heating portion 210 is matched with the sink groove, so that the surface of the heating portion 210 can be flush with the non-recessed portion of the atomization surface 110. Of course, an arrangement manner of the electrode portion 220 on the substrate 100 can be the same as that of the heating portion 210. In terms of material, the heating portion 210 can be made of a metal material. In terms of structure, the heating portion 210 can have a line-shaped structure or a membrane-shaped structure. When the heating portion 210 has a membrane-shaped structure, the heating portion 210 can be a dense metal film, a porous metal film, or the like. The thickness H3 of the membrane-shaped heating portion 210 ranges from 30 μm to 130 μm, for example, the specific value can be 30 μm, 50 μm, 100 μm, 130 μm, or the like. The electrode portion 220 may also have a line-shaped structure or a membrane-shaped structure.

Referring to FIG. 2, FIG. 3, and FIG. 4, in some embodiments, the protective layer 300 can be a membrane-shaped structure. The protective layer 300 is a porous ceramic layer made of a porous ceramic material, so that a large number of micropores can be formed inside the protective layer 300, accordingly the protective layer 300 also has a certain porosity, and the porosity can range from 30% to 70%, for example, the specific value can be 30%, 40%, 60% or 70%. The protective layer 300 is provided on the atomization surface 110, so that the protective layer 300 can cover the entire heating portion 210, such that the protective layer 300 has a protective effect on the heating portion 210. When the heating portion 210 is energized, the heating portion 210 converts the electric energy into heat energy, and the liquid on the atomization surface 110 absorbs the heat and is atomized to form smoke. Given that the protective layer 300 has a certain porosity, the smoke produced on the atomization surface 110 overflows through the micropores inside the protective layer 300 to the outside of the protective layer 300, and finally the smoke is transmitted to the airflow passage 12 to take in by the user. The amount of smoke overflowing from the protective layer 300 per unit time can be in direct proportion to the porosity of the protective layer 300. Therefore, the amount of smoke can be changed by changing the porosity of the protective layer 300. For example, when the porosity of the protective layer 300 is greater, the demand for large amount of smoke can be satisfied.

When the user stops smoking, a pressure at the position where the entire atomizing core 20 is located is relatively small, so that the smoke containing both solid particles and liquid particles flows back to the atomizing core 20. If the protective layer 300 is not provided, most of the liquid particles and solid particles in the smoke may flow directly to the atomizing surface 110 without any hindrance, thereby forming tobacco soot that accumulates on the surface and periphery of the heating portion 210, that is, the tobacco soot covers or surrounds the periphery of the heating portion 210. It is obvious that the tobacco soot is in a direct connection with the heating portion 210. Therefore, a large amount of tobacco soot is formed by accumulating on the surface and periphery of the heating portion 210 in a short time. When the tobacco soot accumulates to a certain amount and when the heating portion 210 generates the heat, the temperatures on the surface and periphery of the heating portion 210 are relatively higher, the tobacco soot may have a chemical reaction at a high temperature to generate a burnt, pungent or other odorous gas, which will be mixed in the smoke and taken in by the user, resulting in a bad taste of the smoke and affecting the user experience. Of course, the tobacco soot may also produce a certain amount of toxic gas, which will affect human health.

However, by providing the protective layer 300 in the above embodiment, most of the liquid particles and solid particles in the smoke are directly absorbed in the protective layer 300, so that the protective layer 300 has a good filtering function and avoids that this part of the liquid particles and solid particles flow to the atomization surface 110 to form the tobacco soot accumulated on the surface and periphery of the heating portion 210, thereby greatly reducing the proportion of liquid particles and solid particles in the smoke which are converted into the tobacco soot, thereby reducing the amount of tobacco soot produced and accumulated on the surface and periphery of heating portion 210 due to single smoking. Therefore, within the same period of time, the amount of tobacco soot accumulated on the surface and periphery of the heating portion 210 and the speed of the accumulation may be greatly reduced. In the case where the amount of the smoke tobacco soot is less than a certain value, the tobacco soot cannot produce burning, pungent, or other odorous gases at high temperatures that affect the taste of the smoke, thereby ensuring the taste and user experience of the smoke. At the same time, the tobacco soot can be prevented from generating toxic gases, and the safety of the atomizer 10 during use can be improved.

In fact, the liquid in the liquid storage cavity 11 usually contains essence, and nicotine salt can even be added. When the liquid is atomized by absorbing heat, the essence is decomposed to obtain high molecular compounds, and the nicotine salt produces carbonate. The above high molecular compounds and the carbonate serve as a catalytic, which make more liquid particles and solid particles in the smoke quickly converted into tobacco soot, that is, the conversion rate of tobacco soot is increased, thereby further accelerating the accumulation of the tobacco soot. However, by providing the protective layer 300 in the above embodiment, the protective layer 300 can give full play to its own absorption and filtering functions, which can not only hinder the rapid flow of the liquid particles and solid particles, but also in view of the fact that the protective layer 300 uses a ceramic material, the ceramic material can increase the absorption of the above-mentioned high molecular compounds and carbonates, and can reduce the catalysis during the formation of the tobacco soot, thereby reducing the amount of the tobacco soot accumulated.

At the same time, by providing the protective layer 300, both the protective layer 300 and the substrate 100 can form a certain effect of sandwiching on the heating portion. The protective layer 300 can absorb external impact energy and prevent the external impact from directly acting on the heating part, thereby reducing the offset function of the external impact force and the thermal stress generated during the heating process on the adhesive force of the heating portion, and preventing the heating portion from falling off the substrate 100 and improving the stability and reliability of the heating portion fixed on the substrate 100. In addition, the protective layer 300 can also absorb and buffer the liquid leakage from the substrate 100 to a certain extent, prevent the entire atomizing core 20 from leaking in a short period of time, and improve the leakage prevention performance of the atomizing core 20.

In some embodiments, the protective layer 300 may further cover the electrode portions 220 of the heating element 200. For example, the protective layer 300 may cover all the electrode portions 220. By covering the electrode portions 220, the protective layer 300 can protect the electrode portions 220, reduce the offset effect of external impact force and thermal stress on the adhesive force of the electrode portions 220, thereby preventing the electrode portions 220 from falling off the substrate 100, and improving the stability and reliability of the electrode portions 220 fixed on the substrate 100.

The protective layer 300 has a certain thickness H2; and the thickness H2 ranges from 100 μm to 500 μm. For example, the specific value can be 100 μm, 200 μm, 300 μm, or 500 μm. When the thickness of the protective layer 300 increases, a flow resistance of the liquid particles and solid particles in the micropores and a flow path to the atomization surface 110 can be increased, thereby increasing the absorption function of the protective layer 300 on the liquid particles, the solid particles, the high molecular compounds and carbonates, and reducing the amount of the tobacco soot accumulated. Of course, when the thickness of the protective layer 300 is larger, the volume of the protective layer 300 increases, which can increase the amount of liquid leakage buffered by the protective layer 300 from the substrate 100 and improve the leakage prevention performance of the atomizing core 20.

Figure 6:
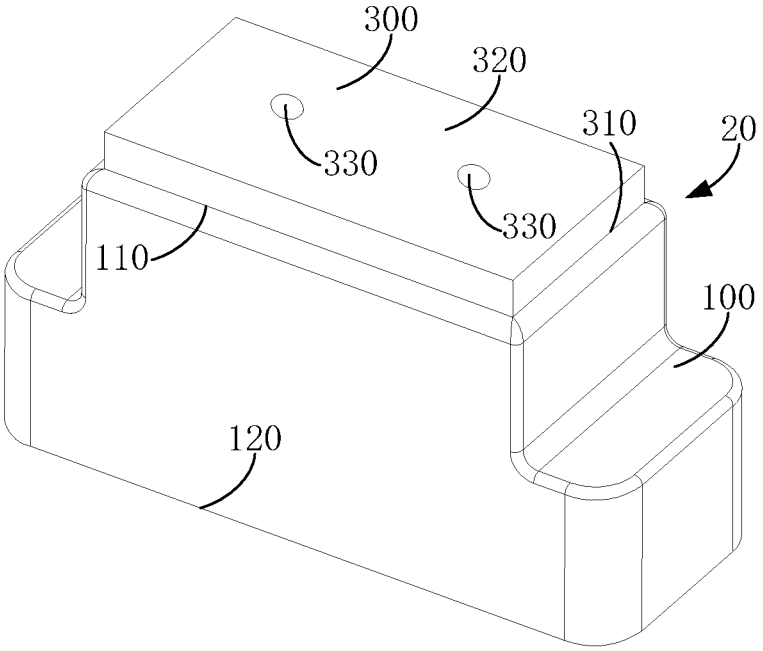
FIG. 6 is a schematic three-dimensional structure diagram of an atomizing core of the atomizer shown in FIG. 1 according to an embodiment of the present disclosure.
Figure 7:
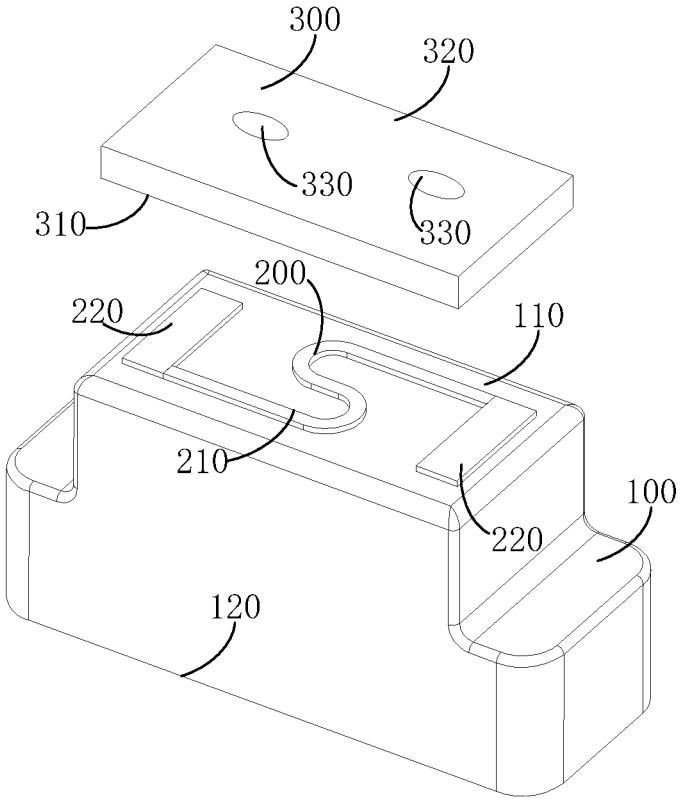
FIG. 7 is a schematic exploded structure diagram of the atomizing core shown in FIG. 6.
Figure 8:
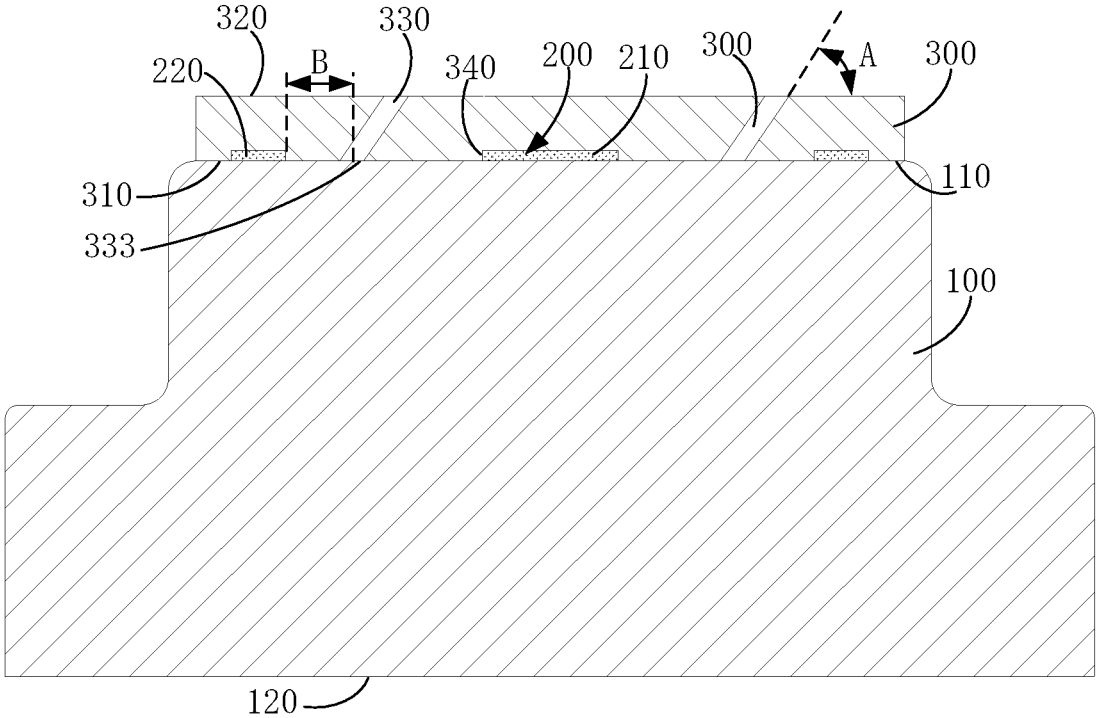
FIG. 8 is a schematic plan section view of the atomizing core shown in FIG. 6 according to an embodiment of the present disclosure.

Referring to FIGS. 6, 7 and 8, in some embodiments, the protective layer 300 has a covering surface 310 and a bottom surface 320. The bottom surface 320 and the covering surface 310 face oppositely and are spaced along the thickness direction of the protective layer 300. The covering surface 310 faces the atomization surface 110 of the substrate 100, and the bottom surface 320 faces away from the atomization surface 110. When the protective layer 300 is provided on the atomization surface 110, the covering surface 310 covers the heating portion 210. A vent hole 330 is provided inside the protective layer 300. One end of the vent hole 330 passes through the covering surface 310, and the other end of the vent hole 330 passes through the bottom surface 320 to communicate with the outside. Obviously, for the atomizing core 20 installed in the atomizer 10, The vent hole 330 is in communication with the airflow passage 12 (see FIG. 1). By providing the vent hole 330, since an aperture of the vent hole 330 is several orders of magnitude higher than that of the micropore, the flow resistance of the smoke entering the airflow passage 12 through the protective layer 300 can be reduced. Specifically, the flow resistance of the smoke in the vent hole 330 is significantly smaller than the flow resistance in the micropores. When the heating portion 210 atomizes the liquid on the atomization surface 110 to form smoke, except for a small part of the smoke that is discharged into the airflow passage 12 through the micropores in the protective layer 300, most of the smoke can be quickly discharged into the airflow passage 12 through the vent hole 330 to ensure that a sufficient amount of smoke per unit time enters the airflow passage 12 to take in by the user, to ensure that the amount of smoke discharged from the atomizing core 20 into the airflow passage 12 per unit time can meet the demand of the user.

In some embodiments, for example, the vent hole 330 covers the covering surface 310 to form a through opening 333. The through opening 333 has an orthographic projection on the atomization surface 110, and the orthographic projection is kept at a set distance B from the coverage of the heating portion 210. When the user stops smoking, the smoke flowing back to the atomizing core 20 can also enter the protective layer 300 through the vent hole 330 and flow to the atomization surface 110. Since the through opening 333 is kept at a set distance B from the coverage of the heating portion 210 on the atomization surface, the smoke flowing back to the vent hole 330 forms the tobacco soot in an area on the atomization surface 110 approximate to the through opening 333. The tobacco soot is not directly connected to the heating portion 210 but is kept at a set distance from the heating portion 210. Because the location of the tobacco soot is far from the heating portion 210, and the amount of the tobacco soot accumulated is smaller, the location of the tobacco soot is difficult to form the high temperature and amount of substance required for the chemical reaction of the tobacco soot, accordingly the tobacco soot is difficult to produce burnt smell or other peculiar smell of gas. For another example, the entire vent hole 330 has an orthographic projection on the atomization surface 110, and the orthographic projection is kept at a set distance from the coverage of the heating portion 210, so that the smoke entering the vent hole 330 is difficult to pass through the micropores in the protective layer 300 to reach the surface or periphery of the heating portion 210, thereby further preventing the smoke from forming tobacco soot on the surface or periphery of the heating portion 210.

Figure 9:
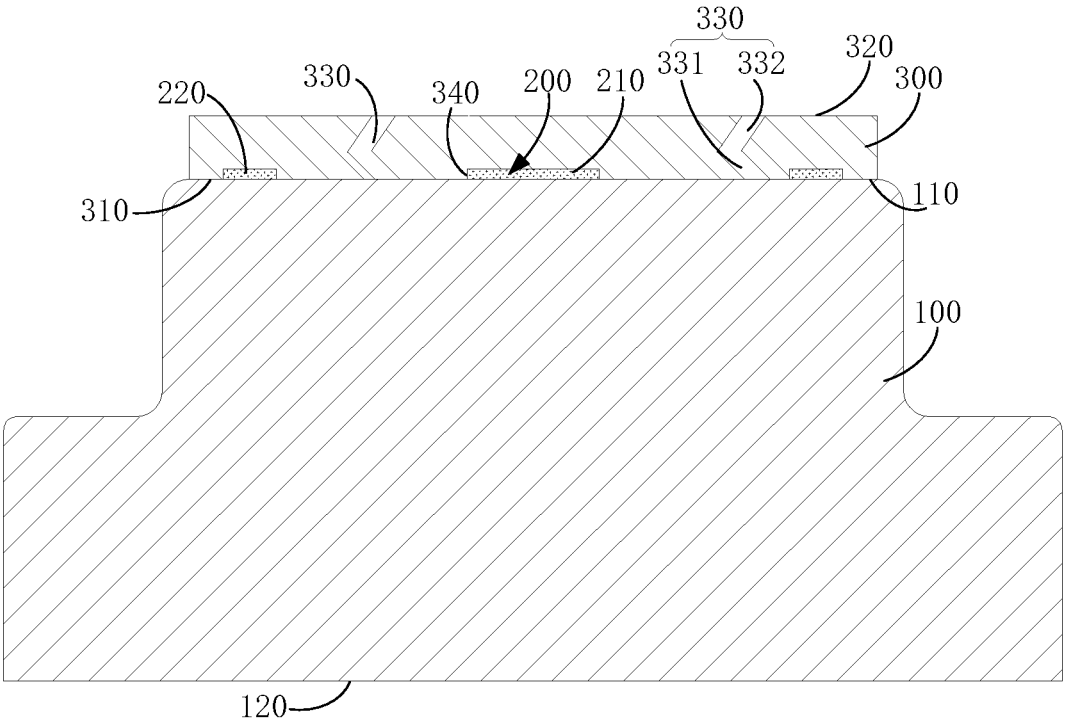
FIG. 9 is a schematic plan section view of the atomizing core shown in FIG. 6 according to an embodiment of the present disclosure.

Referring to FIG. 8, a central axis of the vent hole 330 can be linear, and there is an acute angle between the central axis of the vent hole 330 and the atomization surface 110, that is, the vent hole 330 is arranged obliquely with respect to the atomization surface 110, so that a total extension length of the vent hole 330 can be appropriately increased, to extend the flow path of the smoke in the vent hole 330 and increase the contact area with the protective layer 300, resulting in an increase in the flow resistance of the smoke and an increase in the absorption capacity of the protective layer 300 to the smoke, in order to prevent the smoke from forming the tobacco soot on the atomization surface 110. Referring to FIG. 9, the central axis of the vent hole 330 may also be in the shape of a polyline. For example, the vent hole 330 includes a first bending section 331 and a second bending section 332 which are in communication with each other. The first bending section 331 passes through the covering surface 310 while the second bending section 331 passes through the bottom surface 320 and directly communicates with the outside (corresponding to the airflow passage 12). The central axis of the first bending section 331 is arranged at an angle with the atomization surface 110; the central axis of the second bending section 332 is arranged at an angle with the central axis of the first bending section 332, thereby further increasing the total extension length of the vent hole 330 and further preventing the smoke from forming the tobacco soot on the atomization surface 110.

The covering surface 310 of the protective layer 300 is recessed to form a groove 340, and at least a part of the heating portion 210 can be matched with the groove 340, so that the heating portion 210 can full use of the installation space of the groove 340, and the atomizing core 20 has a compact structure; meanwhile, the groove 340 also forms a limit effect on the heating portion 210, which improves the stability and reliability of the installation of the heating portion 210.

Figure 10:
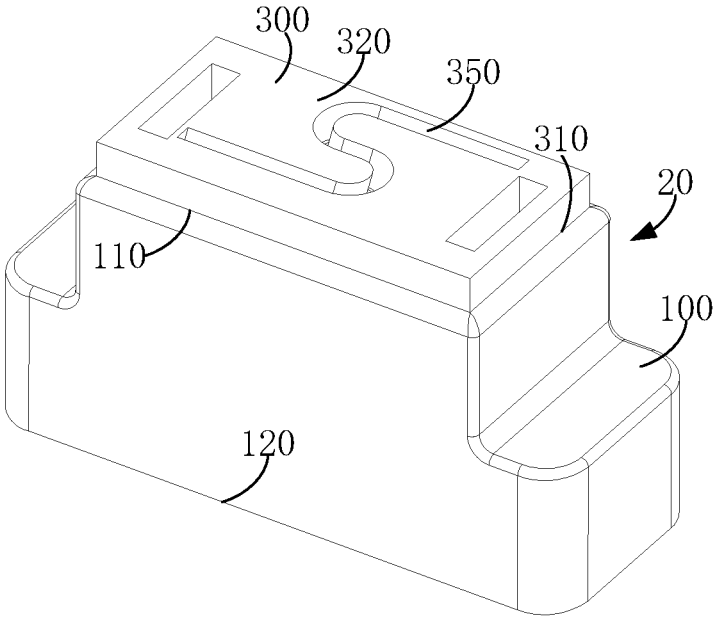
FIG. 10 is a schematic three-dimensional structure diagram of the atomizing core provided by the second embodiment.
Figure 11:
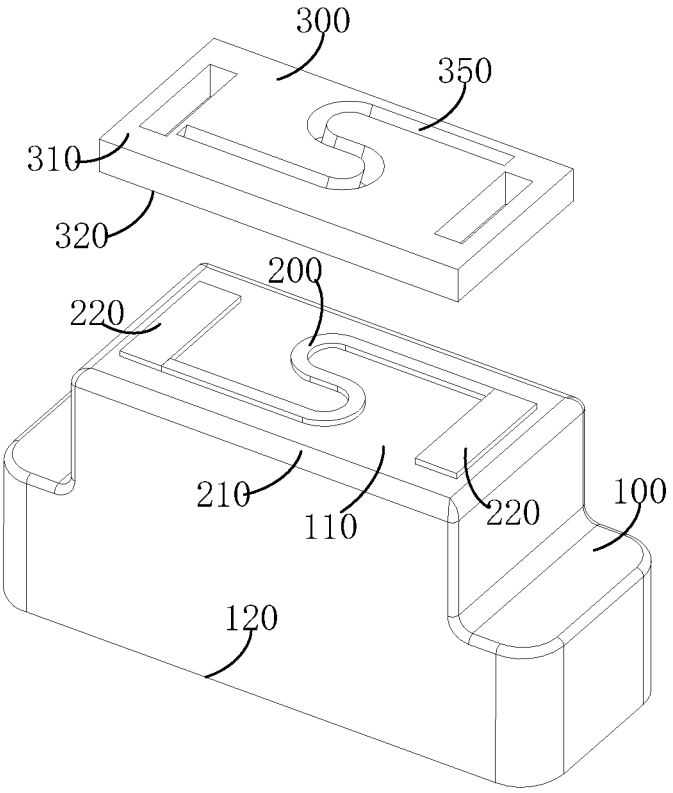
FIG. 11 is a schematic exploded structure diagram of the atomizing core shown in FIG. 10.
Figure 12:
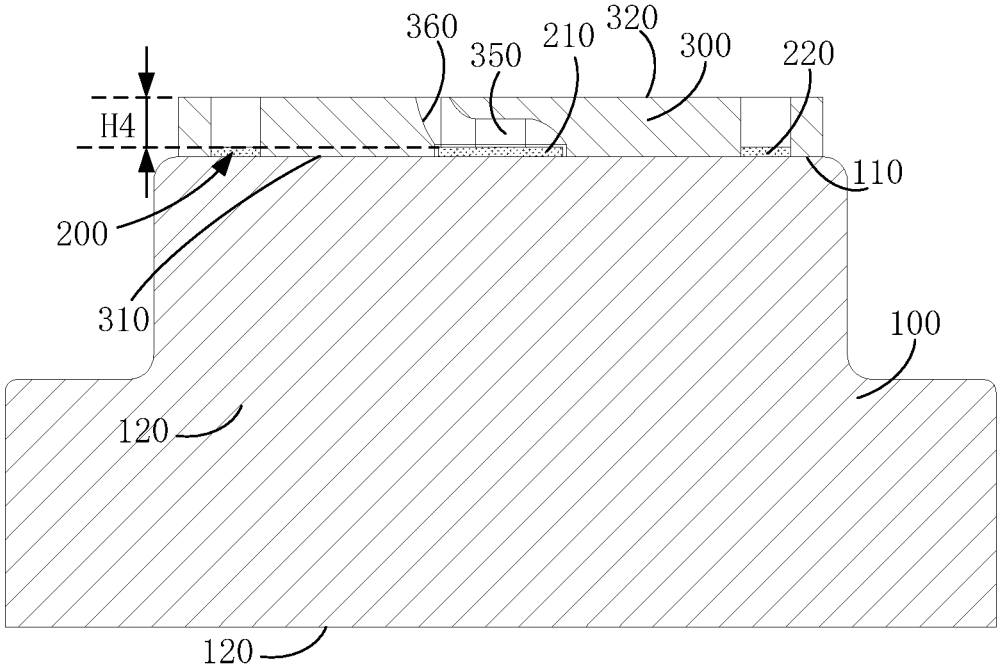
FIG. 12 is a schematic plan section view of the atomizing core shown in FIG. 10.

Referring to FIGS. 10, 11 and 12, in other embodiments, the protective layer 300 cannot cover the heating portion 210 at all. Specifically, the protection layer 300 is provided with a through groove 350 that passes through the entire protection layer 300; one end of the through groove 350 passes through the bottom surface 320, and the other end of the through groove 350 passes through the covering surface 310. When the protective layer 300 is fixed on the atomization surface 110, the shape of the cross section of the heating portion 210 is matched with the shape of the cross section of the through groove 350, so that the heating portion 210 is located in the through groove 350 and is matched with the through groove 350. Along the thickness direction of the protective layer 300, the surface of the heating portion 210 in the through groove 350 is kept at a set distance H4 from the bottom surface 320 of the protective layer 300. In fact, the protective layer 300 is arranged around the edges of the heating portion 210. Due to the obstructive effect of the protective layer 300, it is difficult for the smoke flowing back to the atomizing core 20 to pass through the micropores of the protective layer 300 to reach a portion of the atomization surface 110 approximate to the heating portion 210, thereby significantly reducing the amount of tobacco soot accumulated around the heating portion 210. At the same time, the protective layer 300 has a side wall surface 360 that defines the boundary of the through groove 350. Since the surface of the heating portion 210 in the through groove 350 is kept at a set distance H4 from the bottom surface 320 of the protective layer 300, the side wall surface 360 has a large enough area. In the process that the smoke flowing back flows to the heating portion 210 through the through groove 350, the smoke collides and contacts with the side wall surface 360, so that the side wall surface 360 has a reasonable contact area and has a strong adsorption capacity for the smoke, so that it is difficult for the smoke to reach the surface of the heating portion 210, thereby preventing the smoke from forming a large amount of tobacco soot on the surface of the heating portion 210, and ensuring the taste of the smoke as well. Of course, the protective layer 300 may also partially cover the heating portion 210 so that the user can only observe a part of the heating portion 210 through the through groove 350 outside the atomizing core 20.

Figure 13:
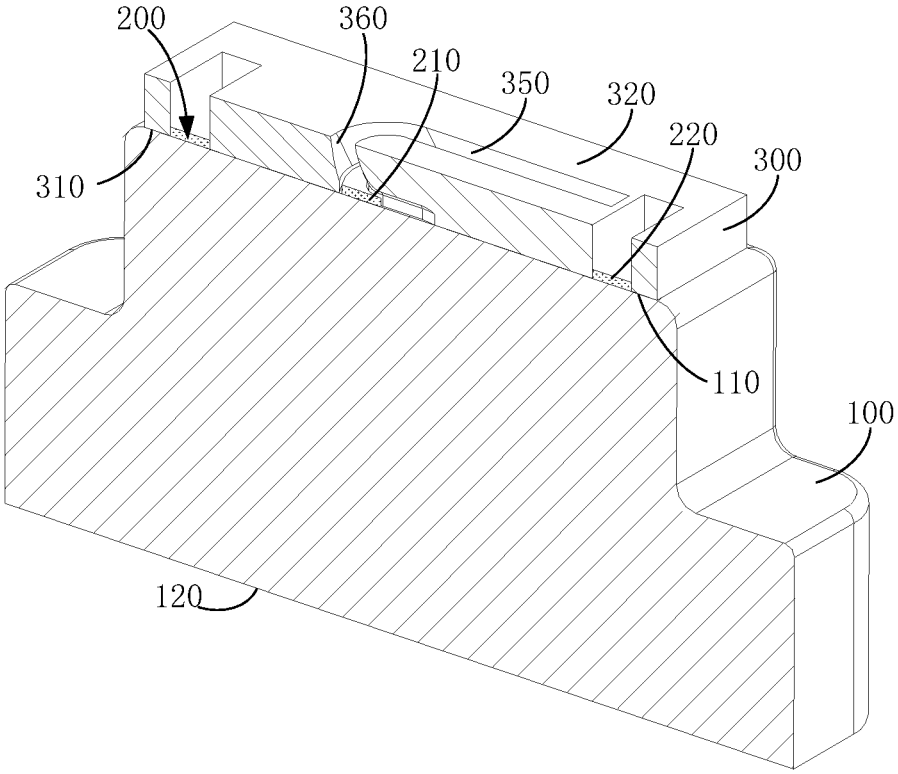
FIG. 13 is a schematic three-dimensional structure diagram of the atomizing core shown in FIG. 10.

Referring to FIG. 13, referring to the arrangement of the above-mentioned vent hole 330, the through groove 350 can also be arranged obliquely with respect to the atomization surface 110, that is, when the through groove 350 passes through the protective layer 330 along a straight line, there is an acute angle between the extension direction of the straight line and the atomization surface 110. Of course, the through groove 350 can also passes through the protective layer 330 along the polyline. The above arrangement can extend the flow path of smoke in the through groove 350 and increase the contact area with the protective layer 300, resulting in an increase in the flow resistance of the smoke and an increase in the absorption capacity of the protective layer 300 to the smoke, and preventing the smoke from forming the tobacco soot on the heating portion 210. The smoke generated on the atomization surface 110 can be quickly discharged from the through groove 350 into the airflow passage 12 (see FIG. 1), to ensure that the amount of smoke discharged by the atomizing core 20 into the airflow passage 12 per unit time can meet the demand of user. In addition to providing the through groove 350, a vent hole 330 can be provided on the protective layer 300 with reference to the above embodiments. By providing the vent hole 330, the amount of smoke discharged by the atomizing core 20 into the airflow passage 12 per unit time can be further increased.

The present disclosure also provides an electronic atomization device. The electronic atomization device includes a power supply, a controller, a sensor, and the atomizer 10 described above. The power supply is electrically connected to the controller and the heating element 200. When the sensor acquires the suction information of the user and transmits the suction information to the controller, the controller controls the power supply to supply power to the heating element 200, and the heating element 200 converts electrical energy into heat energy, so that the liquid is atomized to form smoke under the action of the heat energy. The above-mentioned suction information can include a negative pressure generated in the airflow passage 12 during the suction process of the user. The electronic atomization device includes the above-mentioned atomizer 10, which can protect the taste and safety of the smoke generated by the electronic atomization device.

The technical features of the above-mentioned embodiments can be combined arbitrarily. In order to make the description concise, all possible combinations of the various technical features in the above-mentioned embodiments are not described. However, as long as there is no contradiction in the combination of these technical features, all should be considered as the scope of the present disclosure.

The above-mentioned embodiments only express several exemplary embodiments of the present disclosure, and the descriptions are relatively specific and detailed, but they should not be interpreted as limiting the scope of the disclosure. It should be pointed out that those of ordinary skill in the art can make several modifications and improvements without departing from the concept of the present disclosure, and these all fall within the protection scope of the present disclosure. Therefore, the scope of protection of the present disclosure shall be subject to the appended claims.

What is claimed is:

1. An atomizing core, comprising:

a substrate, having an atomization surface and being configured to buffer and conduct a liquid;

a heating element, comprising a heating portion attached to the substrate, the heating portion being capable of generating heat to atomize the liquid on the atomization surface to form smoke; and a protective layer, provided on the atomization surface and covering the heating portion, and smoke being capable of overflowing from the protective layer, wherein the protective layer includes a porous ceramic layer made of a porous ceramic material, wherein micropores are formed in the protective layer with a porosity in a range of 30% to 70%, wherein the protective layer is provided with a covering surface and a bottom surface facing oppositely and spaced along a thickness direction of the protective layer, a vent hole is provided inside the protective layer, one end of the vent hole passes through the covering surface, and the other end of the vent hole passes through the bottom surface to communicate with outside, wherein the vent hole is arranged obliquely with respect to the atomization surface.

2. The atomizing core according to claim 1, wherein a thickness of the protective layer is in a range of 100 μm to 500 μm.

3. The atomizing core according to claim 1, wherein the heating element further comprises electrode portions configured to conduct electricity, the electrode portion is electrically connected to the heating portion, and the protective layer covers all the electrode portions.

4. The atomizing core according to claim 1, wherein the protective layer has a covering surface provided towards the atomization surface, the covering surface is recessed to form a groove, and at least a part of the heating portion is matched with the groove.

5. The atomizing core according to claim 1, wherein the heating portion has a line-shaped structure or a metal film structure; when the heating portion is the metal film structure, the thickness of the heating portion is in a range of 30 μm to 130 μm.

6. The atomizing core according to claim 1, wherein micropores are formed in the substrate with a porosity in a range of 20% to 70%, and a thickness of the substrate is in a range of 2 mm to 5 mm.

7. An atomizer, comprising a liquid storage cavity, and the atomizing core according to claim 1, and the substrate further has a liquid absorption surface facing opposite to the atomization surface, the liquid absorption surface is configured to absorb a liquid in the liquid storage cavity into the substrate.

8. An electronic atomization device, comprising a power supply, and the atomizer of claim 7, the power supply is electrically connected to the heating element.

9. The atomizing core according to claim 1, wherein the vent hole forms a through opening on the covering surface, the through opening has an orthographic projection on the atomization surface, and the orthographic projection is kept at a set distance from a coverage of the heating portion.

10. The atomizing core according to claim 1, wherein a central axis of the vent hole has a polyline shape, the vent hole comprises a first bending section and a second bending section which are in communication with each other, the first bending section passes through the covering surface, and the second bending section passes through the bottom surface and directly communicates with the outside, a central axis of the first bending section is arranged at an angle with the atomization surface, a central axis of the second bending section is arranged at an angle with the central axis of the first bending section.

11. An atomizing core, comprising:

a substrate, having an atomizing surface and being configured to buffer and conduct a liquid;

a heating element, comprising a heating portion attached to the substrate, the heating portion be capable of generating heat to atomize the liquid on the atomization surface to form smoke; and a protective layer, provided on the atomization surface, wherein the protective layer has a bottom surface that faces away from the atomization surface, and the bottom surface is provided with a through groove passing through the protective layer, at least a part of the heating portion is located in the through groove, and a surface of the heating portion in the through groove is kept at a set distance from the bottom surface along a thickness direction of the protective layer, wherein the protective layer includes a porous ceramic layer made of a porous ceramic material, wherein micropores are formed in the protective layer with a porosity in a range of 30% to 70%, wherein the protective layer is provided with a covering surface arranged opposite to the bottom surface to cover the atomization surface, the covering surface and the bottom surface are spaced along the thickness direction of the protective layer, and the protective layer is provided with a vent hole passing through the covering surface and in communication with outside, and smoke is capable of overflowing from the vent hole, wherein the vent hole is arranged obliquely with respect to the atomization surface.

12. The atomizing core according to claim 11, wherein the vent hole forms a through opening on the covering surface, the through opening has an orthographic projection on the atomization surface, and the orthographic projection is kept at a set distance from a coverage of the heating portion.

13. The atomizing core according to claim 11, wherein the vent hole has an orthographic projection on the atomization surface, and the orthographic projection is kept at a set distance from a coverage of the heating portion.

14. The atomizing core according to claim 11, wherein a central axis of the vent hole is arranged at an acute angle with the atomization surface; or, the vent hole comprises a first bending section and a second bending section which are in communication with each other, the first bending section passing through the covering surface, the second bending section is in direct communication with the outside, a central axis of the first bending section is arranged at an angle with the atomization surface, a central axis of the second bending section is arranged at an angle with the central axis of the first bending section.

* * * * *